US005803244A

United States Patent [19]

Shefler et al.

[11] Patent Number: 5,803,244

[45] Date of Patent: Sep. 8, 1998

[54] EYEGLASS CASE WITH CLOSURE FLAP

[75] Inventors: Don N. Shefler, Las Vegas, Nev.; Charles H. Newcomer, Wilderville, Oreg.

[73] Assignee: TEC Vision, Inc., Murray, Utah

[21] Appl. No.: 834,532

[22] Filed: Apr. 4, 1997

Related U.S. Application Data

[63] Continuation-in-part of Ser. No. 41,179, Jul. 7, 1995.

[51] Int. Cl.[6] ..... A45C 11/04

[52] U.S. Cl. ..... 206/6; 206/5

[58] Field of Search ..... 206/5, 5.1, 6, 528, 206/538, 216, 459.5

[56] References Cited

U.S. PATENT DOCUMENTS

| | | | |
|---|---|---|---|
| 51,957 | 1/1866 | Minor . | |
| D. 148,815 | 2/1948 | Olevin . | |
| D. 175,537 | 9/1955 | Combridge . | |
| D. 176,236 | 11/1955 | Stegeman . | |
| D. 179,462 | 12/1956 | Stegeman . | |
| 300,411 | 6/1984 | Borst . | |
| D. 351,945 | 11/1994 | Kopel . | |
| 410,798 | 9/1889 | Long . | |
| 1,004,474 | 9/1911 | Schnorr . | |
| 1,095,744 | 5/1914 | Smith . | |
| 1,277,210 | 8/1918 | Goelkel et al. . | |
| 1,427,947 | 9/1922 | Flitton . | |
| 1,469,524 | 10/1923 | McArthur . | |
| 1,503,979 | 8/1924 | Callahan . | |
| 1,633,417 | 6/1927 | Perry . | |
| 1,649,255 | 11/1927 | Robinson . | |
| 1,995,664 | 3/1935 | Boyes . | |
| 1,999,328 | 4/1935 | Lessard . | |
| 2,187,176 | 1/1940 | Schutz . | |
| 2,187,178 | 1/1940 | Schutz . | |
| 2,233,859 | 3/1941 | Wick . | |
| 2,308,112 | 1/1943 | Schutz . | |
| 2,458,567 | 1/1949 | Cramer . | |
| 2,479,472 | 8/1949 | Coplon . | |
| 2,522,909 | 9/1950 | Wadanoli . | |
| 2,710,685 | 6/1955 | Baratelli | 206/5 |
| 2,805,766 | 9/1957 | Nathan | 206/5 |
| 3,000,417 | 9/1961 | Goldstein . | |
| 3,050,181 | 8/1962 | Nathan | 206/5 |
| 3,070,141 | 12/1962 | Lowy . | |
| 3,144,127 | 8/1964 | Fogel . | |
| 3,232,638 | 2/1966 | Dishart . | |
| 3,785,480 | 1/1974 | Minasian . | |
| 4,865,186 | 9/1989 | Gates . | |
| 4,951,811 | 8/1990 | Lines . | |
| 4,960,208 | 10/1990 | Tempke . | |
| 4,984,682 | 1/1991 | Cummins | 206/5 |
| 5,016,749 | 5/1991 | Kaye et al. . | |
| 5,249,675 | 10/1993 | Strauss et al. . | |
| 5,333,732 | 8/1994 | Budny et al. | 206/5 |
| 5,513,744 | 5/1996 | Yabarra | 206/5 |
| 5,590,760 | 1/1997 | Astarb | 206/5 |

*Primary Examiner*—Paul T. Sewell
*Assistant Examiner*—Luan K. Bui

[57] ABSTRACT

An eyeglass case includes a substantially rigid internal shell member surrounded by a flexible covering material provided with a closure flap selectively securable in a closed position for retaining eyeglasses in protective storage within the inner shell member. The shell member includes one or more internal receptacles for storage of miscellaneous accessory items such as nose pads, spare screws, a small screwdriver, lens cleaning solution, a lens wiping cloth, contact lenses, contact lens solutions, medications, etc.

20 Claims, 6 Drawing Sheets

EYEGLASS CASE WITH CLOSURE FLAP

This application is a C.I.P. of 29/041,179, filed Jul. 7, 1995, pending.

BACKGROUND OF THE INVENTION

The present invention relates to eyeglass cases and more particularly pertains to an eyeglass case having internal compartments for storing accessory items.

SUMMARY OF THE INVENTION

The present invention discloses an eyeglass case generally comprising a substantially rigid internal shell member surrounded by a flexible covering material provided with a closure flap selectively securable in a closed position for retaining eyeglasses in protective storage within the inner shell member. In accordance with embodiments of the invention, the shell member includes one or more internal receptacles for storage of miscellaneous accessory items such as nose pads, spare screws, a small screwdriver, lens cleaning solution, a lens wiping cloth, contact lenses, contact lens solutions, medications, etc.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
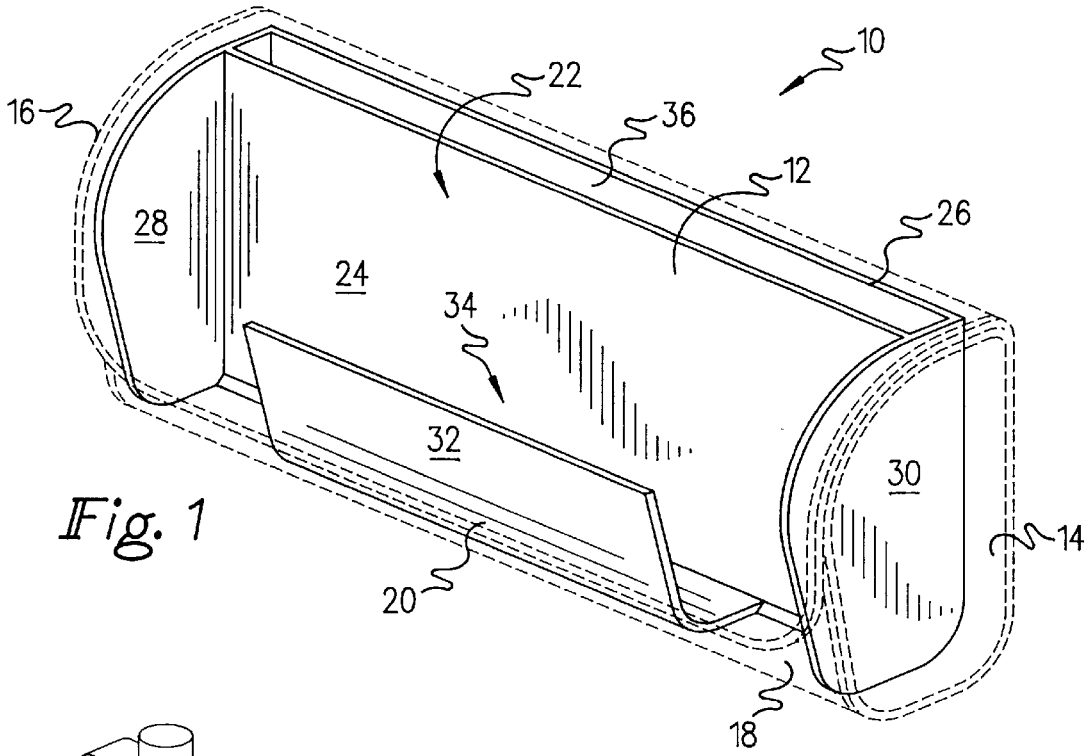
FIG. 1 is a diagrammatic perspective view illustrating an eyeglass case according to a first embodiment of the present invention, with an outer covering illustrated in phantom line disposed over an internal shell member.

Referring now to the drawings, wherein like reference numerals designate corresponding structure throughout the views, and referring in particular to FIGS. 1 through 12, an eyeglass case 10 according to the present invention includes a substantially rigid inner shell member 22, preferably integrally molded from a plastic material. A cover 12, preferably formed from a flexible material such as fabric, leather, rubber, plastic, or the like, includes end regions 14 and 16 connected by a bottom region 18. A closure flap 20 may be selectively secured to the bottom region 18 of the cover 20 using a conventional fastener, such as cooperating hook and loop type fasteners (VELCRO®) or a snap fastener, to secure the case 10 in a closed configuration, defining an enclosed interior space 34 adapted for the protective storage of eyeglasses (not shown). Selected portions of the cover 12 are preferably fastened to the shell 22 using conventional fastening techniques, such as adhesives.

The shell member 22 includes a front face portion formed by a first planar partition wall 24 extending between spaced, substantially planar and parallel end panels 28 and 30 which project forwardly of the wall 24. A support member 32 extends upwardly from a bottom region of the wall 24, and is adapted to at least partially support eyeglasses thereon. In use, an individual folds the eyeglasses and places them in the space 34 defined between the wall 34 and the support member 32.

In accordance with an important aspect of the instant invention, a second partition wall 36 is disposed in spaced, parallel relation, behind the wall 24, to define a back face of the shell 22. The walls 24 and 26 thus define at least one receptacle 36 adapted to receive and store miscellaneous accessory items. One or more dividers 38 may be disposed between the walls 24 and 26 to form a plurality of separate storage receptacles.

A floor panel (not shown) preferably extends between end panels 28 and 30 and between walls 24 and 26 to close the bottom of the receptacle 36. The closure flap 20 (FIG. 1) of the cover 12 covers the open upper end of the receptacle 36, when the flap 20 is disposed in the closed position shown in FIG. 1. To access the contents of the receptacle 36, a user unfastens and opens the flap 20. Optionally, an additional cover for the receptacle 36 may be employed.

Figure 2:
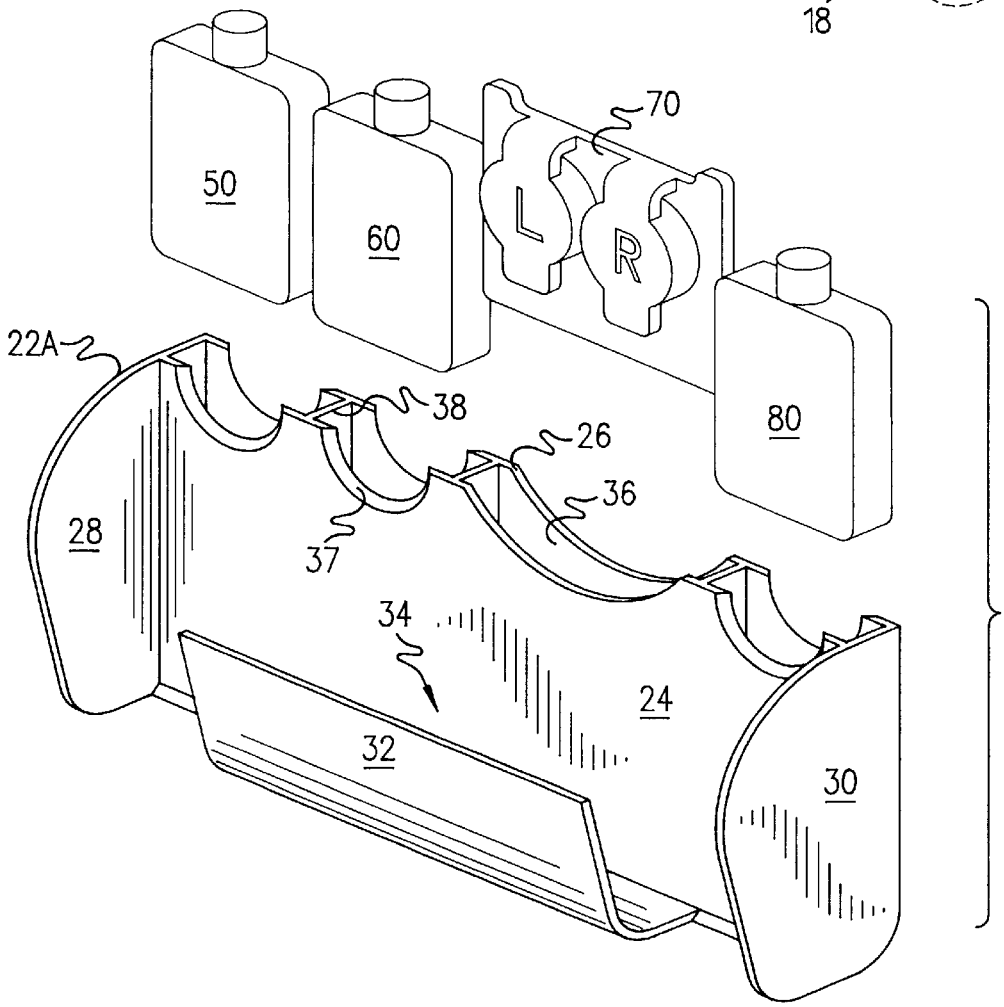
FIG. 2 is an exploded perspective view illustrating an internal shell member of an eyeglass case according to a second embodiment of the present invention.

Numerous different arrangements, sizes, configurations, dimensions, and accessory item storage arrangements are possible within the scope of the present invention by providing differently configured shells 22 and using the identical cover 12. As shown in FIG. 2, one or more transverse dividers 38 may be disposed between the walls 24 and 36 to form a plurality of storage receptacles. Cut-out regions 37 formed in one or both of walls 24 and 26 may be provided to facilitate removal of items from the receptacles.

Representative example embodiments are shown in FIGS. 2–12, showing alternative shell constructions 22A through 22K, respectively.

FIG. 2 illustrates a shell 22A configured for storage of small bottles of wetting solution 50, daily care solution 60, storage and conditioning solution 80, and a hard contact lens case 70.

Figure 3:
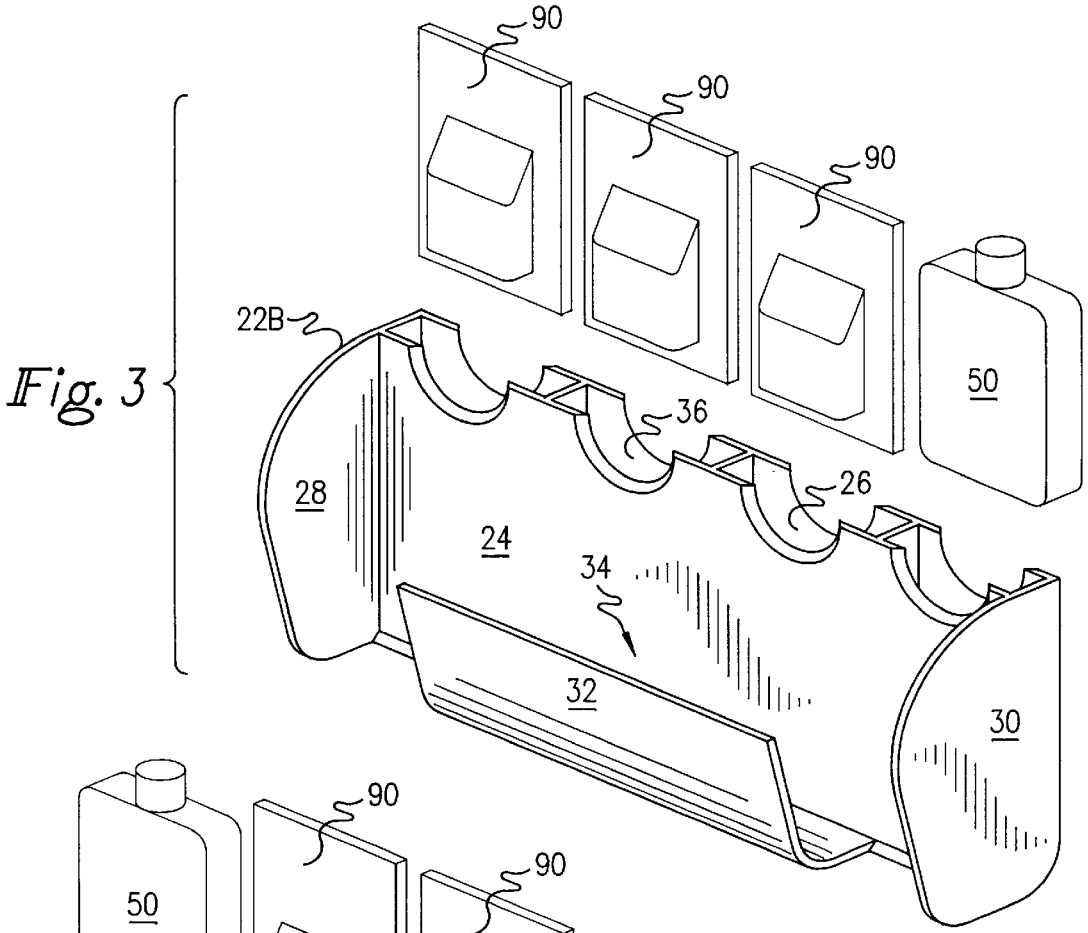
FIG. 3 is an exploded perspective view illustrating an internal shell member of an eyeglass case according to a third embodiment of the present invention.

FIG. 3 illustrates a shell 22B configured for storage of three contact cases 90 and a small bottle of wetting solution 50.

Figure 4:
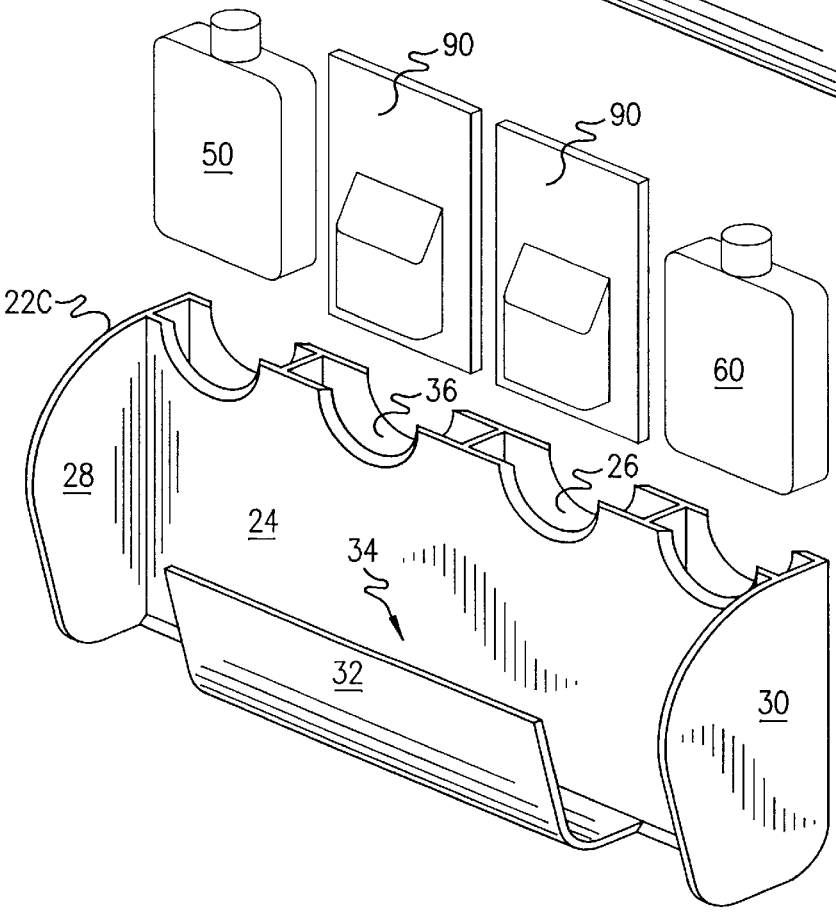
FIG. 4 is an exploded perspective view illustrating an internal shell member of an eyeglass case according to a fourth embodiment of the present invention.

FIG. 4 illustrates a shell 22C configured for storage of small bottles of wetting solution 50, daily care solution 60, and two contact cases 90.

Figure 5:
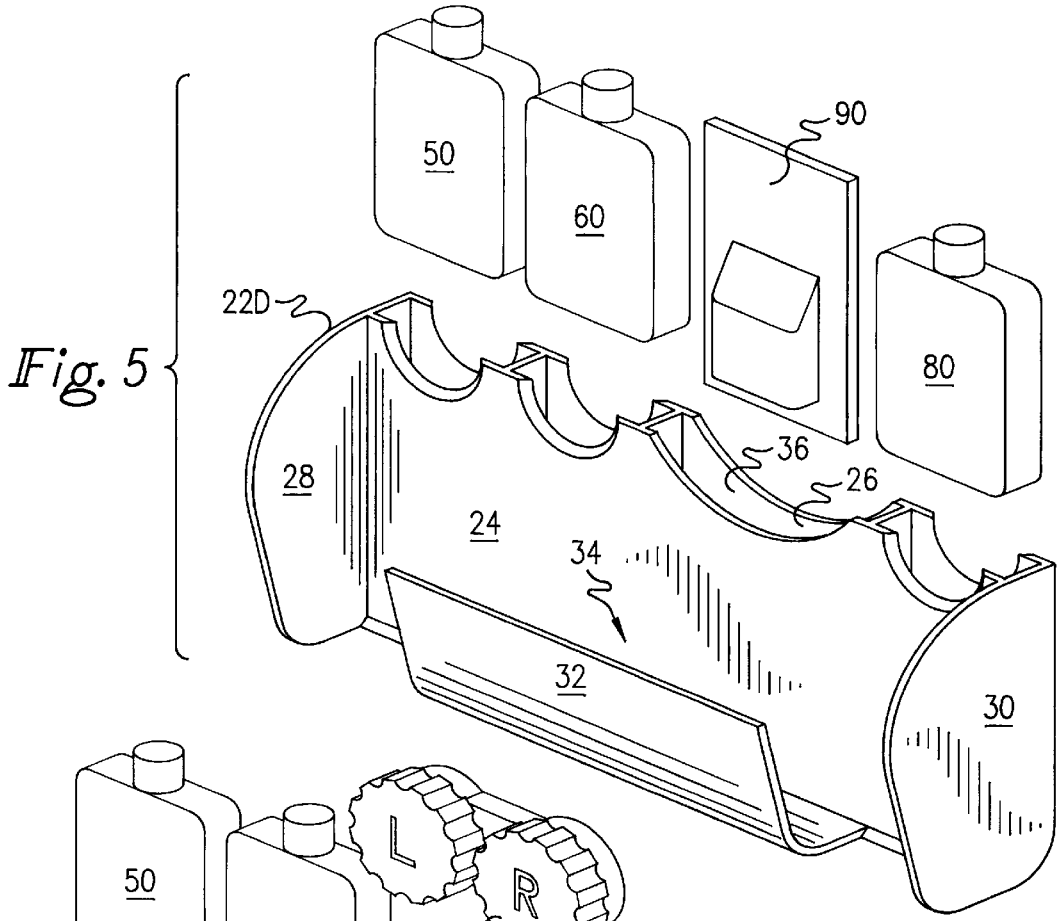
FIG. 5 is an exploded perspective view illustrating an internal shell member of an eyeglass case according to a fifth embodiment of the present invention.

FIG. 5 illustrates still another alternative shell 22D configured for storage of small bottles of wetting solution 50, daily care solution 60, storage and conditioning solution 80, and one contact case 90.

Figure 6:
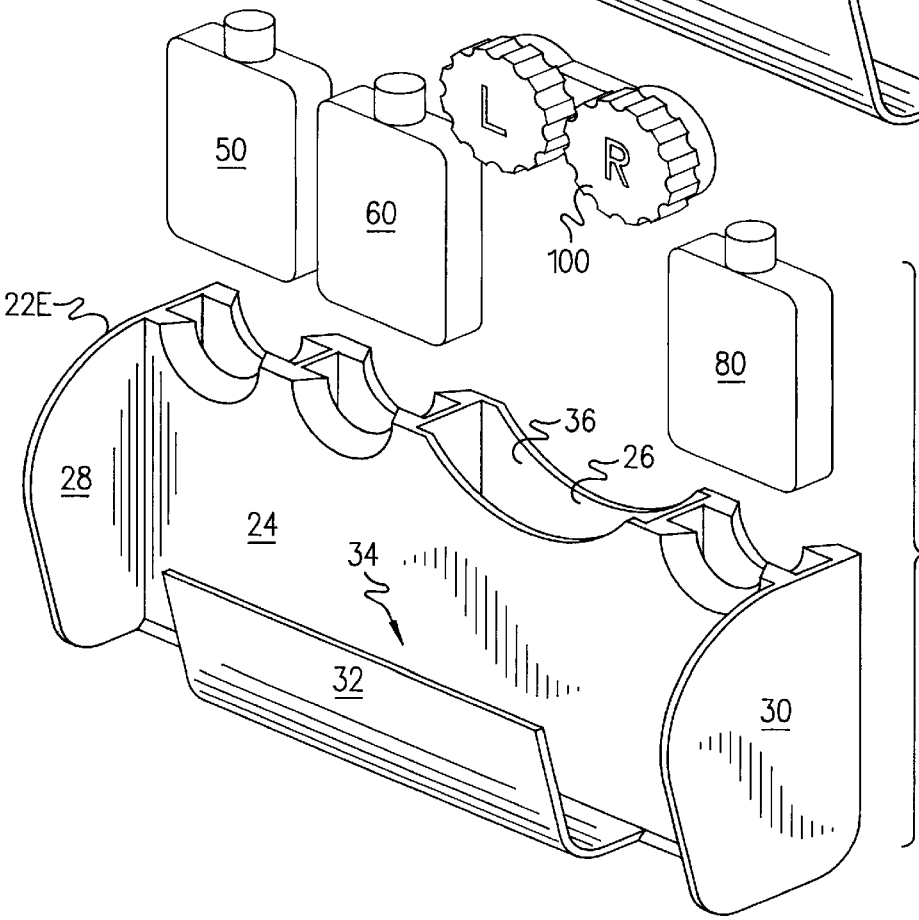
FIG. 6 is an exploded perspective view illustrating an internal shell member of an eyeglass case according to a sixth embodiment of the present invention.

FIG. 6 illustrates another alternative shell 22E configured for storage of small bottles of wetting solution 50, daily care solution 60, storage and conditioning solution 80, and a large soft contact lens case 100.

Figure 7:
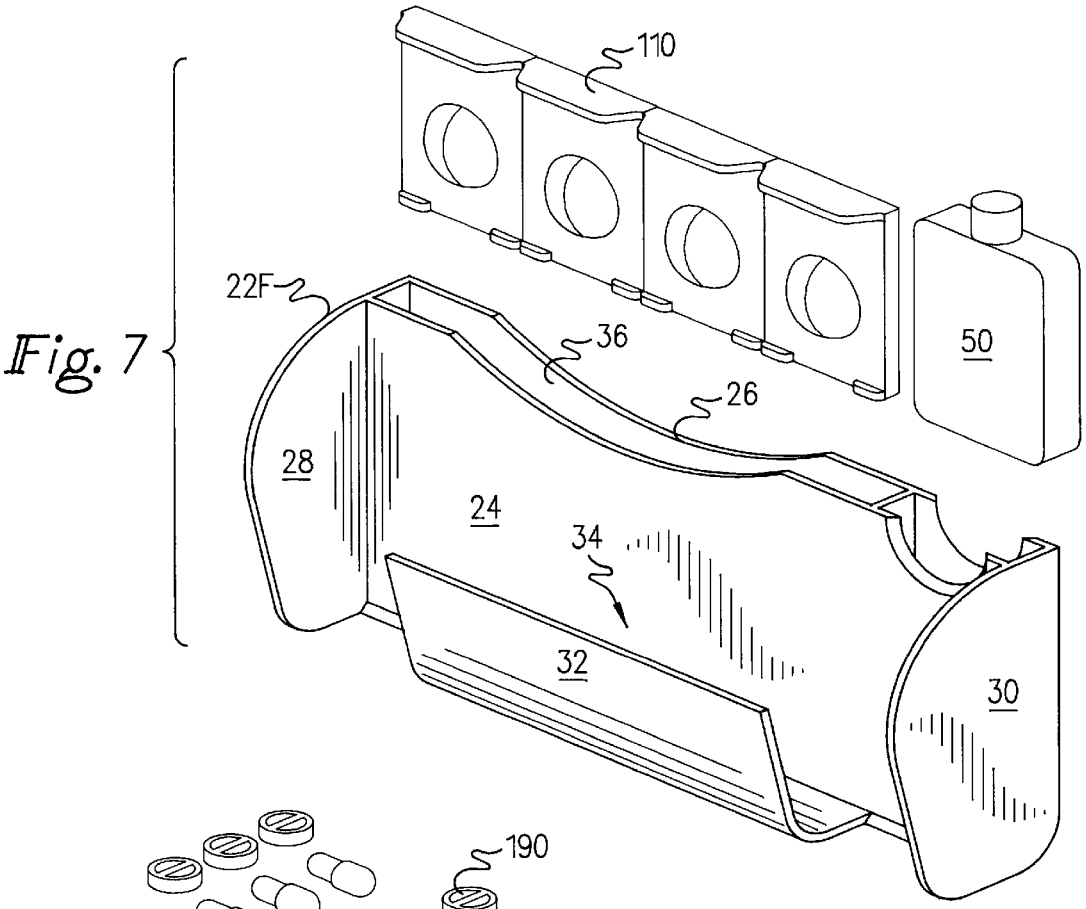
FIG. 7 is an exploded perspective view illustrating an internal shell member of an eyeglass case according to a seventh embodiment of the present invention.

FIG. 7 illustrates an alternative shell 22F configured for storage of a four pack of daily wear contact lenses 110 and a small bottle of wetting solution 50.

Figure 8:
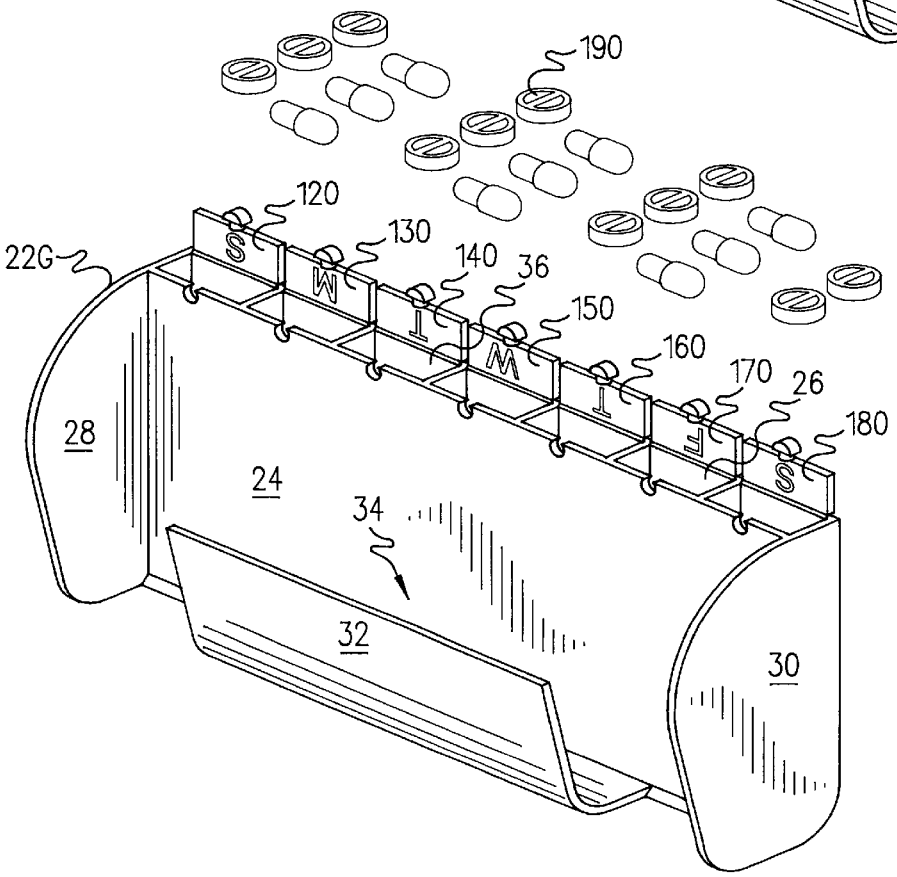
FIG. 8 is an exploded perspective view illustrating an internal shell member of an eyeglass case according to an eighth embodiment of the present invention.

FIG. 8 illustrates an alternative shell 22G provided with seven receptacles, 120, 130, 140, 150, 160, 170, and 180 each bearing indicia designating one of the seven days of the week for the purpose of storage of daily supplies of medication 190.

Figures 9, 10:
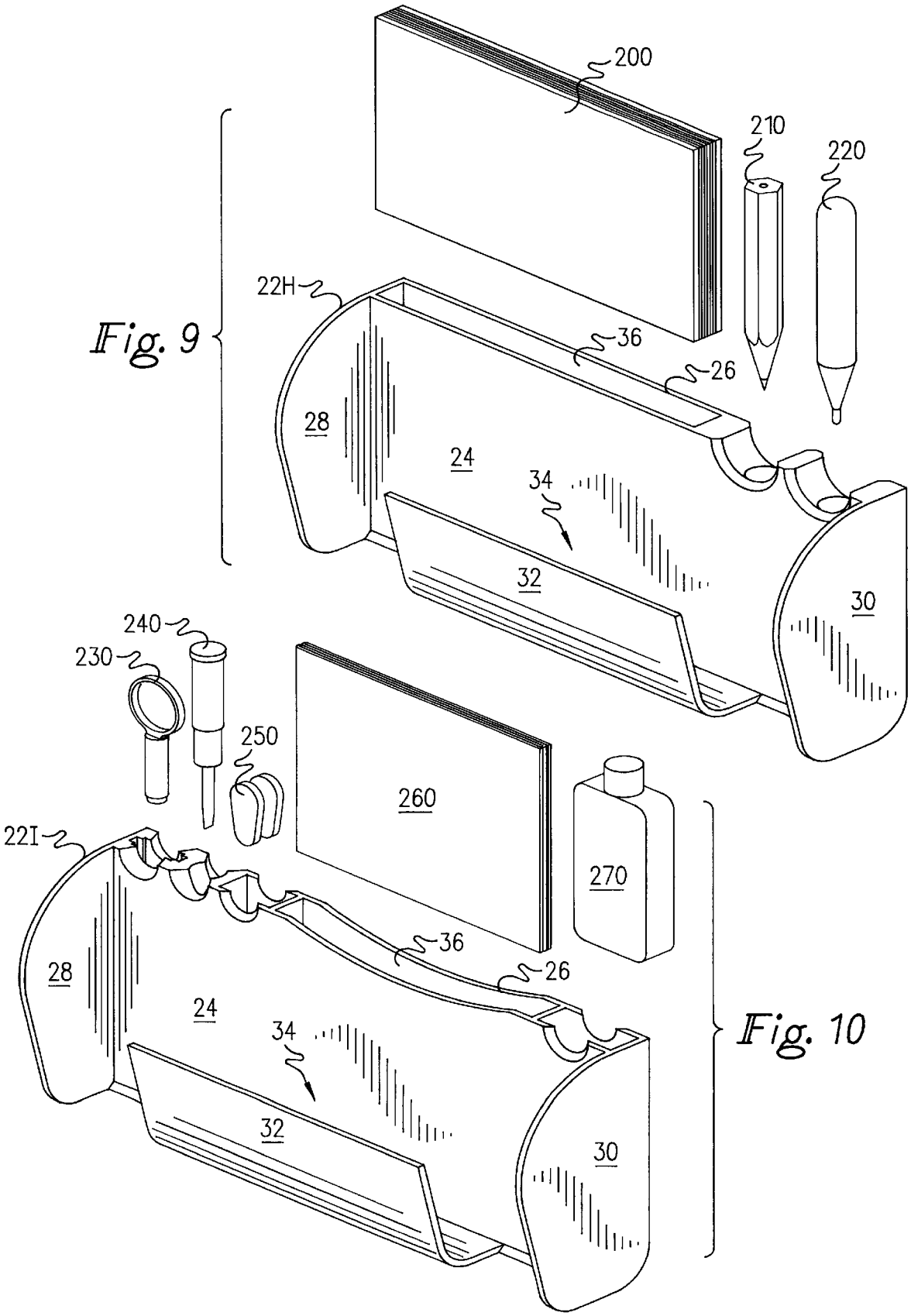
FIG. 9 is an exploded perspective view illustrating an internal shell member of an eyeglass case according to an ninth embodiment of the present invention.
FIG. 10 is an exploded perspective view illustrating an internal shell member of an eyeglass case according to an tenth embodiment of the present invention.

FIG. 9 illustrates an alternative shell 22H configured for storage of a notepad 200, a pencil 210, and a pen 220.

FIG. 10 illustrates a shell 22I configured for storage of a small magnifying glass 230, a screwdriver 240, nose pads 250, a cloth 260, and a small bottle of eyeglass cleaner 270.

Figure 11:
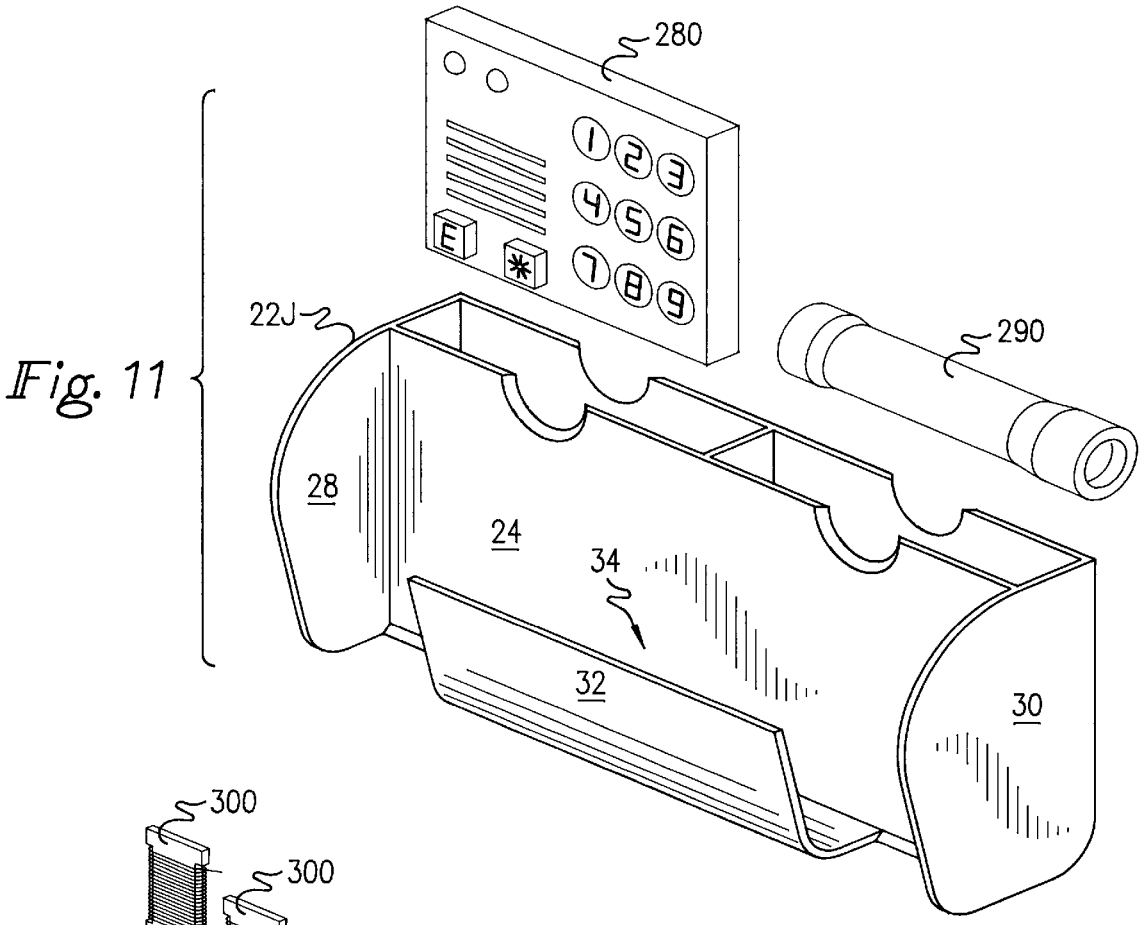
FIG. 11 is an exploded perspective view illustrating an internal shell member of an eyeglass case according to an eleventh embodiment of the present invention.

FIG. 11 illustrates a shell 22J configured for storage of an electronic personal alarm and/or calculator 280 and a small flashlight 290.

Figure 12:
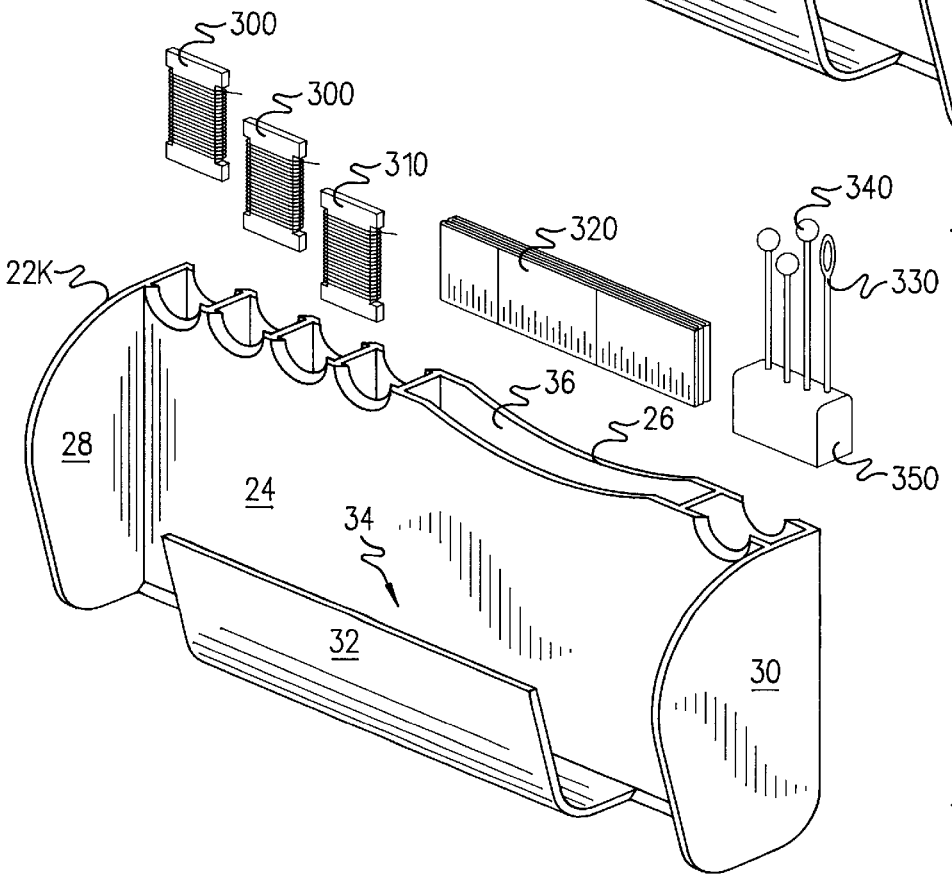
FIG. 12 is an exploded perspective view illustrating an internal shell member of an eyeglass case according to an twelfth embodiment of the present invention.

FIG. 12 illustrates a shell 22K configured for storage of a sewing kit including three thread bundles 300, a tape measure 320, needle 330, pins 340, and pin cushion 350.

The above illustrated and described alternative shell configurations are exemplary only, and numerous other shell configurations, dimensions, and associated accessory items may be provided without departing from the intended scope and content of the instant invention.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed, and reasonable equivalents thereof.

What is claimed is:

1. An eyeglass case, comprising:

an inner shell member;

a cover substantially surrounding said inner shell member and provided with a closure flap for selectively securing eyeglasses within said inner shell member;

said shell member comprising a pair of spaced, substantially aligned end panels, said end panels projecting forwardly of a front face of said shell to define an interior space adapted for receiving eyeglasses for protective storage therein; and said shell member including a pair of spaced partition walls forming at least one internal receptacle for storage of accessory items.

2. The eyeglass case of claim 1, wherein said shell member comprises a substantially rigid member.

3. The eyeglass case of claim 1, wherein said cover comprises a substantially flexible material.

4. The eyeglass case of claim 1, further comprising a support member disposed between said end panels, said support member extending upwardly from a bottom portion of said shell and adapted for supporting eyeglasses thereon.

5. The eyeglasses case of claim 1, wherein one of said partition walls forms a back face of said shell.

6. The eyeglasses case of claim 1, wherein said partition walls are substantially planar and are substantially disposed in parallel spaced relation.

7. The eyeglasses case of claim 6, further comprising at least one divider extending between said partition walls, said divider forming a plurality of internal receptacles.

8. The eyeglasses case of claim 1, further wherein said at least one receptacle comprises a plurality of receptacles.

9. The eyeglasses case of claim 8, wherein said plurality of receptacles have the same dimensions.

10. The eyeglasses case of claim 8, wherein said receptacles have different dimensions.

11. The eyeglasses case of claim 1, wherein said closure flap substantially overlies and closes an open upper end of said internal receptacle in a closed position of said flap.

12. An eyeglasses case, comprising:

an inner shell member comprising a substantially rigid material;

a cover comprising a substantially flexible material, said cover substantially surrounding said inner shell member and provided with a closure flap for selectively securing eyeglasses within said inner shell member;

said shell member including a pair of spaced substantially parallel partition walls forming at least one internal receptacle for storage of accessory items, one of said partition walls forming a back face of said shell;

said shell member including a pair of spaced, substantially aligned end panels, said end panels projecting forwardly of a front face of said shell to define an interior space adapted for receiving eyeglasses for protective storage therein; and a support member disposed between said end panels, said support member extending upwardly from a bottom portion of said shell and adapted for supporting eyeglasses thereon.

13. The eyeglasses case of claim 12, further comprising at least one divider extending between said partition walls, said divider forming a plurality of internal receptacles.

14. The eyeglasses case of claim 12, wherein said closure flap substantially overlies and closes an open upper end of said internal receptacle in a closed position of said flap.

15. The eyeglasses case of claim 12, wherein at least one of said partition walls includes a cut out portion to facilitate removal of an accessory item from said receptacle.

16. The eyeglasses case of claim 12, further wherein said at least one receptacle comprises a plurality of receptacles.

17. The eyeglasses case of claim 16, wherein said plurality of receptacles have the same dimensions.

18. The eyeglasses case of claim 16, wherein said receptacles have different dimensions.

19. The eyeglasses case of claim 16, wherein said plurality of receptacles comprises seven receptacles including associated indicia designating each receptacle with a corresponding day of the week.

20. An eyeglasses case, comprising:

an inner shell member;

a cover substantially surrounding said inner shell member;

said shell member including a pair of spaced substantially parallel partition walls forming at least one internal receptacle for storage of accessory items, one of said partition walls forming a back face of said shell;

said shell member including a pair of spaced, substantially aligned end panels, said end panels projecting forwardly of a front face of said shell to define an interior space adapted for receiving eyeglasses for protective storage therein; and a support member disposed between said end panels, said support member extending upwardly from a bottom portion of said shell and adapted for supporting eyeglasses thereon.

* * * * *